United States Patent [19]

Goineau

[11] Patent Number: 4,865,264

[45] Date of Patent: Sep. 12, 1989

[54] YARN DISTRIBUTOR BLOCK

[75] Inventor: Andre M. Goineau, Spartanburg, S.C.

[73] Assignee: Milliken Research Corporation, Spartanburg, S.C.

[21] Appl. No.: 317,913

[22] Filed: Mar. 2, 1989

[51] Int. Cl.[4] ..... B65H 49/14; B65H 57/00; B65H 57/12; B65H 57/16

[52] U.S. Cl. ..... 242/131; 242/157 R

[58] Field of Search ..... 242/131, 131.1, 157 R; 57/352, 358; 66/125 R, 127; 28/190, 198, 199, 212, 213

[56] References Cited

U.S. PATENT DOCUMENTS

| | | | |
|---|---|---|---|
| 3,690,586 | 9/1972 | Bock | 242/131 |
| 3,716,203 | 2/1973 | Beasley | 242/131 |
| 3,875,883 | 4/1975 | Eberwein et al. | 242/131.1 X |
| 3,915,406 | 10/1975 | Rolli et al. | 242/131 |
| 4,540,138 | 9/1985 | Gutschmit | 242/131 |
| 4,572,458 | 2/1986 | Bluhm et al. | 242/131 |

*Primary Examiner*—Stanley N. Gilreath

*Attorney, Agent, or Firm*—Earle R. Marden; H.William Petry

[57] ABSTRACT

A compact yarn distributor block mounted on the bottom of a yarn creel to direct yarn supplied from yarn packages on the creel to the point of use of a yarn processing machine, such as a texturing machine. The yarn outlet openings in the yarn distributor block are displaced vertically from one another so that the yarn from one outlet can be supplied without interference from yarn being supplied from another outlet.

6 Claims, 3 Drawing Sheets

FIG. —1—

YARN DISTRIBUTOR BLOCK

This invention relates generally to the supply of yarn from a package on a creel to a yarn processing machine such as a knitting machine or a texturing machine and in particular to a yarn distributor block which maintains the individual yarns separate from one another to facilitate yarn thread-up.

It is therefore an object of the invention to provide a yarn distributor which provides individual treatment for each yarn from each yarn package on a creel being supplied to a yarn processing machine.

Other objects and advantages of the invention will become readily apparent as the specification proceeds to describe the invention with reference to the accompanying drawing, in which.

Figure 1:
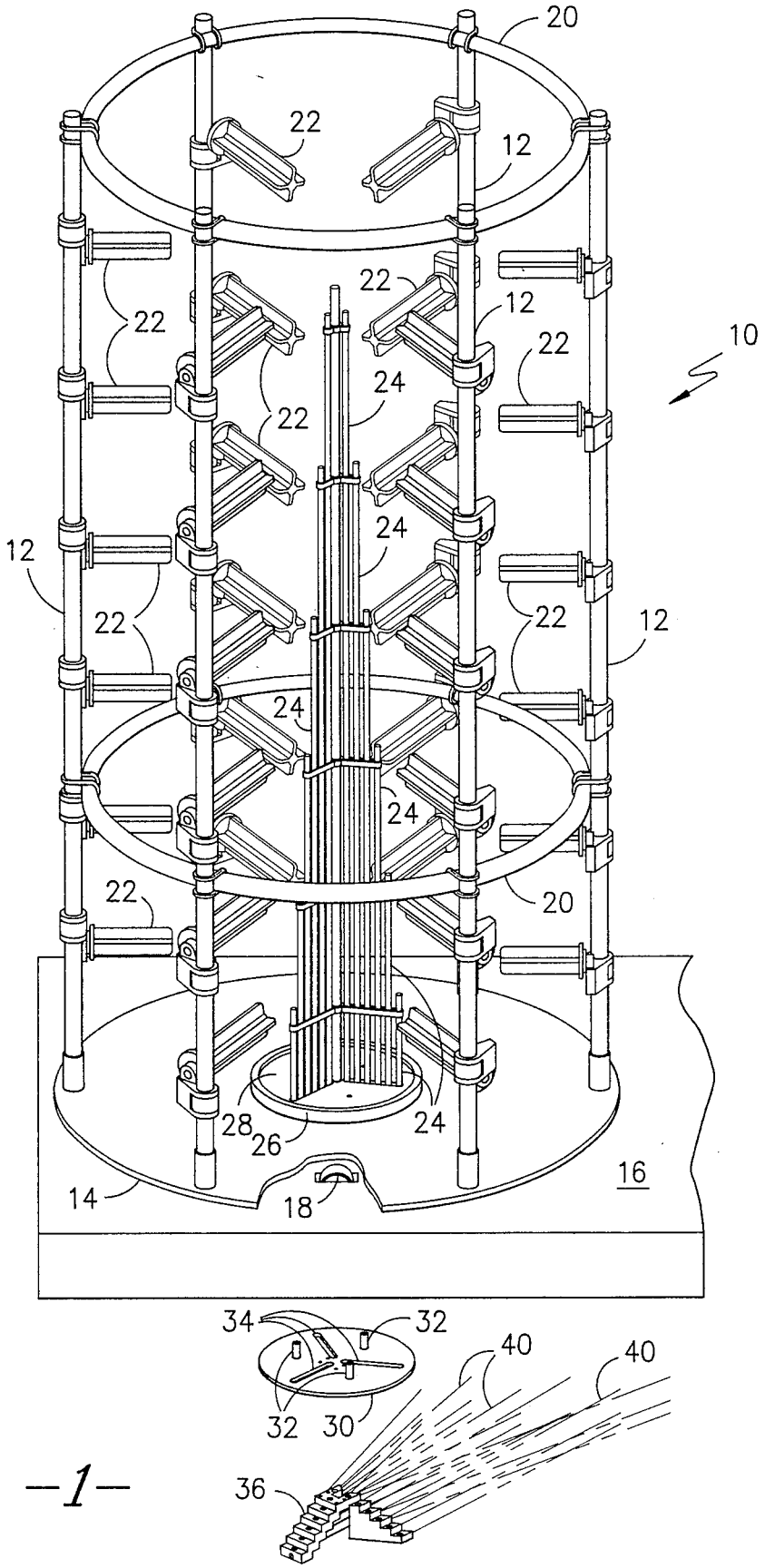
FIG. 1 is a schematic representation of a yarn package creel for yarn being supplied to a texturing machine.
Figure 2:
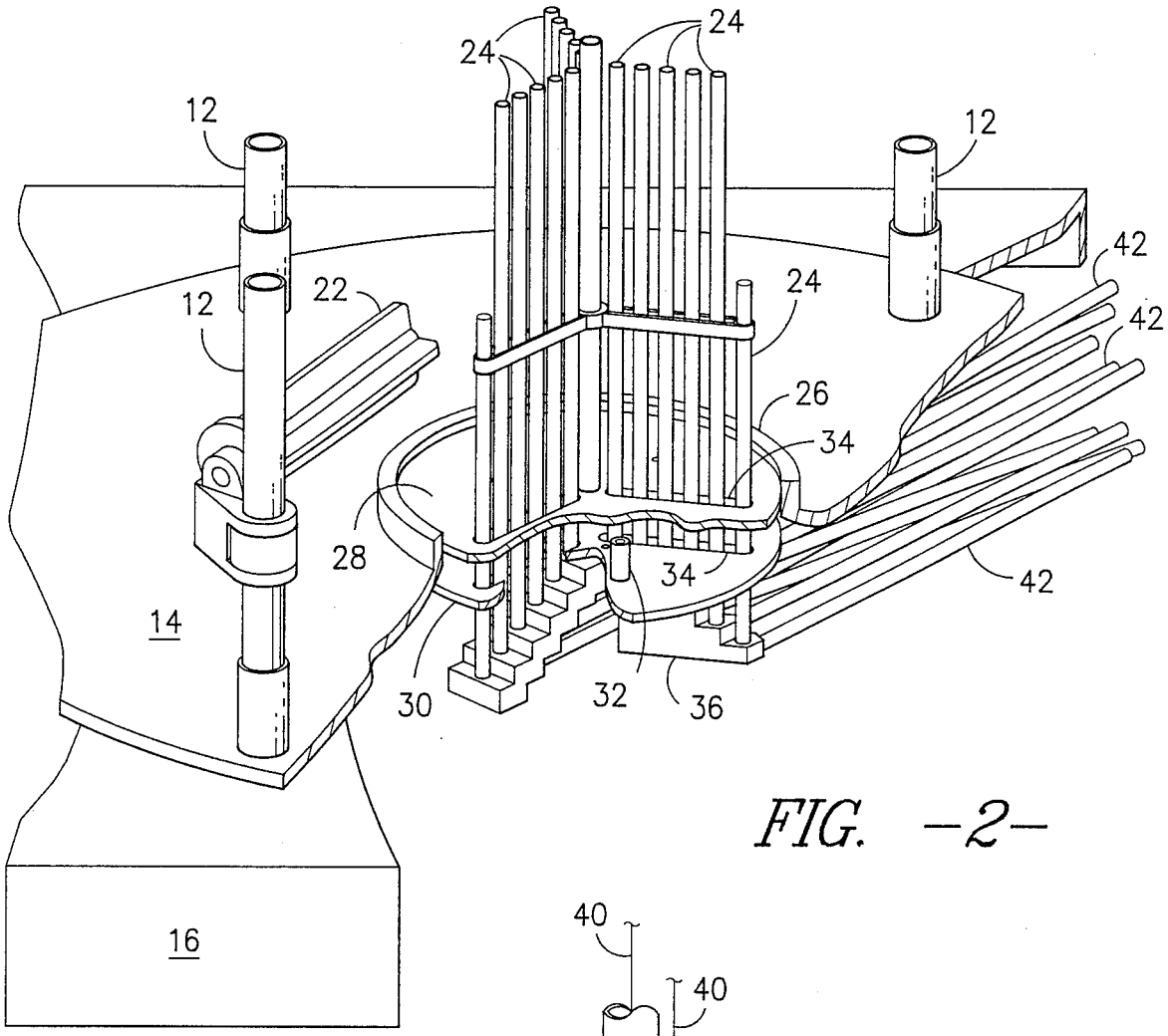
FIG. 2 is a blown-up view of the bottom area of the creel shown in FIG. 1 showing the yarn distributor block.
Figure 3:
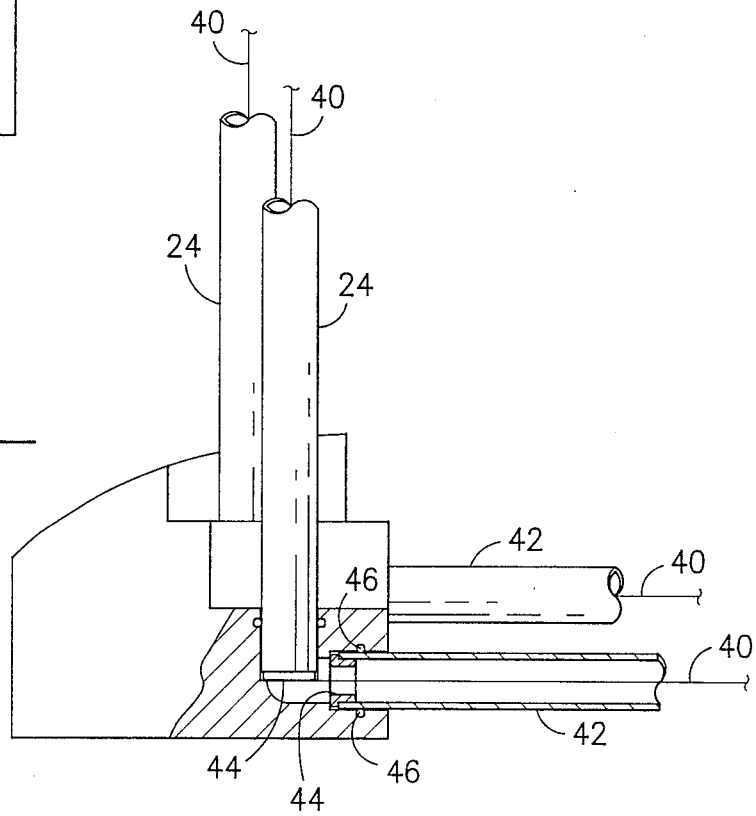
FIG. 3 is a side view of a portion of the yarn distributor block shown in FIG. 2.

Looking now to FIG. 1 there is shown a conventional rotary yarn creel 10, which in the preferred form of the invention is supplying a plurality of yarns to a synthetic yarn texturing machine. The creel 10 has a plurality of upright supports 12 mounted on the base plate 14 which can be rotated with respect to the base member 16 on wheels 18. The upright supports 12 are interconnected by rings 20 and have a plurality of yarn package support members or holders 22. In the creel shown there are 36 support members 22 to allow 18 yarn packages to be run and to have a reserve package for each yarn package being run. Since, as in the preferred embodiment of the invention, the yarn from the packages in the yarn package holders 22 is very lively, such as POY polyester or nylon continuous filament yarn, guide tubes 24 are provided for each individual yarn end. As can be seen in FIGS. 1 and 2 there are eighteen guide tubes 24 for yarn from the eighteen packages being supplied to the texturing machine, not shown. It should be noted that the guide tubes 24 are of varying height depending on the particular location of the yarn package holder 22.

Centrally located on the base plate 14 is a ring member 26 which rotates with the base plate around a pair of fixed circular plates 28 and 30 spaced from one another by spacers 32 through which screws are inserted to hold the spacers together. Each of the plates have a plurality of elongated, elliptical openings 34 therein to accommodate the desired number of guide tubes 24.

As shown in exploded fashion in FIG. 1 and in detail in FIG. 2 a yarn distributor block 36 is connected to the bottom of circular plate 30 and the guide tubes 24 passing through the slots 34 in the plates 28 and 30 are connected to the openings 38 in the top of the block 36. As schematically represented in FIG. 1, the yarn 40 in the guide tubes is guided outwardly from the block 36 generally perpendicular to the guide tubes 24 to the yarn process machine, not shown, in a fashion so as to not interfere with adjacent yarns. To insure that the yarns do not interfere with one another it is preferred that a yarn guide tube 42 be employed to guide each yarn 40 from the block 36 to the yarn consuming machine.

When supplying a multiplicity of yarn ends from a creel to a point of use it is desired to maintain them separate from one another to prevent abrasion and/or entanglement. When using guide tubes, like tubes 42, it is desired that the tubes do not cross one another since they tend to form bends therein which cause the yarn to rub thereon causing weak spots in the yarn. To provide this separation of yarn ends the distributor block 36 was designed. Each of the ends of the tubes 24 and 42 in the block 36 have a ceramic guide 44 therein to reduce any wear on the tubes by the yarn 40 and have an O-ring 46 around the outside thereof to maintain pressure in the tubes 24 and 42 when a suction device is attached to the outer end of tube 42 to pull yarn therethrough on threadup.

Figure 4:
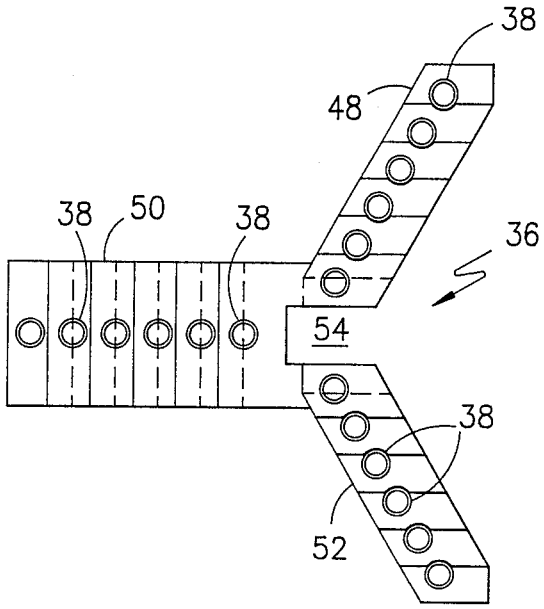
FIG. 4 is a top view of the yarn distributor per se.
Figure 5:
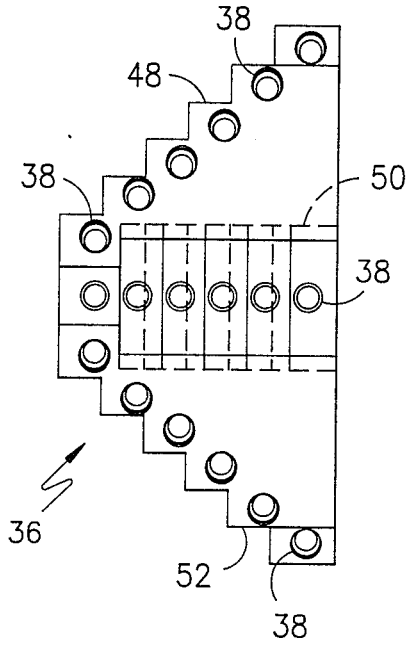
FIG. 5 is a side elevational view of the yarn distributor of FIG. 4.
Figure 6:
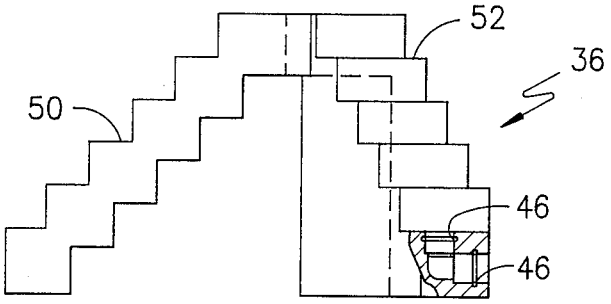
FIG. 6 is a right hand side elevational view of the yarn distributor of FIG. 4.

Since the creels 10 are necessarily large due to the number of packages thereon and normally cannot be located directly in line with the yarn processing positions being supplied yarn therefrom it is necessary to provide a means to direct the yarn from the creel to a particular position without interference with the yarn being supplied to other yarn processing positions. To this end the yarn distributor block 36 shown in detail in FIGS. 4–6 is used. As mentioned before the yarn distributor block is of integral construction having a plurality of arms 48, 50 and 52. Each of the arms 48, 50 and 52 are stepped so that the supplied yarn to adjacent positions is spaced vertically to reduce the possibility of interference. In the preferred form of the invention six yarns are supplied to each arm with the center arm 50 supplying yarn through the space 54 between the arms 48 and 52. It can be seen from FIG. 5 that each opening 38 in the arms is spaced from the other openings 38 so that the guide tubes 42 connected thereto can be directed to the yarn processing machine without interference with one another. Also, the yarn distributor block arrangement provides the machine operator the ease of identification when an end comes down because they know which ends are being supplied to which tubes so that it is comparatively easy to identify the yarn package to where the broken end came from.

Although the preferred embodiment of the invention has been described, it is contemplated that many changes may be made without department from the scope or spirit of the invention and it is desired that the invention be limited only by the claims.

I claim:

1. A creeling system for a multiplicity of yarn packages supplying yarn to a yarn processing machine comprising: an upstanding creel having a plurality of yarn package holders thereon, a yarn guide tube operably associated with each of said yarn package holders and a yarn distributor block mounted in the base of said creel having openings in the top thereof communicating with said yarn guide tubes, said yarn distributor block being of a stepped configuration whereby each yarn guide tube supplies yarn into said block at a point vertically displaced from each of the adjacent yarns supplied from the other yarn guide tubes, said distributor block having a plurality of openings therein with their center lines substantially perpendicular to and operably associated with said yarn guide tubes to guide yarn from said yarn distributor block to a yarn processing machine, each of said openings having its center line displaced from the center line of the next adjacent openings to supply the yarn therefrom in spatial relationship to one another.

2. The creeling system of claim 1 wherein a second set of yarn guide tubes are connected to said yarn distributor block with one guide tube connected to each of said openings.

3. The creeling system of claim 2 wherein each of the ends of all the yarn guide tubes communicating with said yarn distributor block is sealed against ingress of outside atmospheric conditions whereby when a suction pressure is exerted on the free end of the tubes of said second set to pull yarn through both sets of tubes and said yarn distributor block.

4. The creeling system of claim 3 wherein a ceramic yarn guide is located in the end of each of the tubes in said second set connected to said yarn distributor block.

5. An integral yarn distributor block having at least two arms radially displaced from one another, each of said arms having portions stepped in relation to adjacent portions, means forming first openings in the top of each stepped portion and means forming second openings in the side of each step portion in communication with and having a center line substantially perpendicular to the center line of the corresponding first openings.

6. The yarn distributor block of claim 5 wherein said block has at least three arms equidistant radially from one another.

* * * * *